US007131749B2

(12) United States Patent
Wimberly

(10) Patent No.: US 7,131,749 B2
(45) Date of Patent: Nov. 7, 2006

(54) HEAT DISTRIBUTING HYBRID REFLECTOR LAMP OR ILLUMINATION SYSTEM

(76) Inventor: Randal Lee Wimberly, 905 Tyree Rd., Paducah, KY (US) 42003

( * ) Notice: Subject to any disclaimer, the term of this patent is extended or adjusted under 35 U.S.C. 154(b) by 249 days.

(21) Appl. No.: 10/924,173

(22) Filed: Aug. 21, 2004

(65) Prior Publication Data

US 2005/0041430 A1 Feb. 24, 2005

Related U.S. Application Data

(60) Provisional application No. 60/497,212, filed on Aug. 21, 2003.

(51) Int. Cl.
*F21V 7/06* (2006.01)
*F21V 7/08* (2006.01)
*F21V 11/00* (2006.01)

(52) U.S. Cl. ..... 362/297; 362/347; 362/303

(58) Field of Classification Search ..... 362/346, 362/347, 350, 328, 359, 297, 303, 304, 305; 313/114; 353/94, 99
See application file for complete search history.

(56) References Cited

U.S. PATENT DOCUMENTS 1,575,327 A * 3/1926 Garford et al. ..... 362/303
1,995,012 A * 3/1935 Rivier ..... 362/284
3,267,274 A * 8/1966 Johnson ..... 362/282
3,443,086 A * 5/1969 Rikis ..... 362/303
4,305,099 A * 12/1981 True et al. ..... 348/759
4,447,865 A * 5/1984 VanHorn et al. ..... 362/305
4,654,758 A * 3/1987 Szekacs ..... 362/516
4,755,918 A * 7/1988 Pristash et al. ..... 362/301
5,789,847 A * 8/1998 Woodward et al. ..... 313/113
6,168,293 B1 * 1/2001 Lieszkovszky et al. ..... 362/297
6,488,379 B1 * 12/2002 Kane ..... 353/94
6,585,397 B1 * 7/2003 Ebiko ..... 362/297
6,586,864 B1 * 7/2003 Zhou et al. ..... 313/113

* cited by examiner

*Primary Examiner*—Stephen Husar
*Assistant Examiner*—Peggy A. Neils

(57) ABSTRACT

A reflector lamp or illumination system comprising a concave reflector having a parabolic or ellipsoidal front section and a spherical rear section with it's focal point just ahead of the focal point of the front section, and a finite light source located at the focal point of the front section. The reflector sections are dimensioned so that light rays from the finite light source which are reflected by the spherical rear section become re-reflected by the front section and distributed more evenly in said projected beam pattern with the energy rays filling back in from the edge to the center. Additionally the light rays, re-reflected by the front section, are made up of uncompressed light and energy components which provide a beam pattern which is substantially more even in light and energy distribution, does not have compressed light and energy producing hot spots of light and heat at the center of the projected beam pattern or gate, and is therefore less harmful to parts such as lighting fixture parts, plastic lens and items being projected such as plastic color media, film, and slides.

18 Claims, 6 Drawing Sheets

HEAT DISTRIBUTING HYBRID REFLECTOR LAMP OR ILLUMINATION SYSTEM

This application claims the benefit of U.S. Provisional Application No. 60/497,212, filed Aug. 21, 2003.

REFERENCES CITED

| | | |
|---|---|---|
| U.S. Pat. No. 6,488,379 B2 | Dec. 3, 2002 | Kane |
| U.S. Pat. No. 6,168,293 B1 | Jan. 2, 2001 | Lieszkovszky et. al |
| U.S. Pat. No. 4,755,918 | Jul. 5, 1988 | Pristash et. al |
| U.S. Pat. No. 4,654,758 | Mar. 31, 1987 | Szekacs et. al |
| U.S. Pat. No. 4,447,865 | May 8, 1984 | VanHorn et. al |
| U.S. Pat. No. 3,443,086 | May 6, 1969 | Rikis |
| U.S. Pat. No. 3,267,274 | Nov. 26, 1963 | Johnson |
| U.S. Pat. No. 1,995,012 | Mar. 19, 1935 | Rivier |
| U.S. Pat. No. 1,575,327 | Mar. 2, 1926 | Garford et. al |

TECHNICAL FIELD

The present invention is in the field of reflector lamps and more particularly in the field of optical reflectors for use in collecting a high proportion of the emitted light and projecting a high-intensity beam.

BACKGROUND OF THE INVENTION

Light reflectors have long been used to bounce light off of a reflective surface. Light generally shines in all directions from a light source. However, if light shining in all directions from a light source is not useful, a reflective surface can be employed to reflect light towards a direction in which the light is useful. In this way, light reflectors increase the efficiency of a lamp or light source.

One general type of reflector comprises a concave reflector having a parabolic contour with respect to a focal point, so as to reflect frontwardly and along the lamp axis light emitted by a light source located at and near the focal point. The cross section of the reflector, perpendicular to the lamp axis, usually is circular with the diameter thereof varying with the distance from the focal point.

Another general type of reflector comprises a concave reflector having an ellipsoidal contour with respect to a focal point, so as to reflect frontwardly and along the lamp axis light emitted by a light source located at and near one of the ellipsoidal focal points to the second ellipsoidal focal point located frontwardly and determined by the size of the geometric ellipsoidal contour. The light leaving the ellipsoidal reflector usually passes through a gate and then enters into a series of lenses to more accurately control dispersion of the projected beam of light. The cross section of the reflector, perpendicular to the lamp axis, usually is circular with the diameter thereof varying with the distance from the focal point.

Additionally, a cone of light rays, originating from the light source, pass, unreflected, through the front of the reflector; the angle of this cone of rays being determined and defined by the front rim of the reflector. The more widely divergent light rays of the cone of rays, that is, the rays passing relatively nearer to the rim of the reflector, have such a large sideways component of direction so as to fall outside of the desired light pattern or gate and therefore are wasted.

The wasted, divergent light can be reduced, and the optical efficiency improved, by making the reflector deeper, that is longer, so that relatively more of the light is reflected in the desired direction and the cone of non reflected light is narrowed. However, there are practical limitations on increasing the depth of the reflector, such as cost, weight and awkwardness of use. Also, with a given maximum diameter as the reflector is made deeper, the focal point moves closer to the rear surface, which complicates positioning of the light source in reflector systems and if the light source is a filament inside a reflector lamp there is accelerated blackening of the nearby rear area of the reflector due to evaporation of the filament material (usually tungsten). This accelerated blackening in the reflector lamp can be alleviated by providing a concave recess at the rear portion of the reflector but has the drawback of reducing optical efficiency. In a reflector or reflector system, as the focal point moves closer to the rear surface, the percentage of reflected energy from the finite light source is compressed and packed much more tightly toward the center of the reflector and, as a result, the opening for the finite light source will remove an area of the reflector that would normally reflect a larger percentage of the light being generated than if it were a shallow reflector, thus reducing optical efficiency of the deep reflector system.

Additionally, it has now been found that as the parabolic or ellipsoidal contour of the reflector is made deeper and the focal point is moved closer to the rear of the reflector, the reflected light and heat from the light source is packed more tightly and reflected in a compressed narrower band at the center of the projected beam pattern or gate. This increase in light and heat energy is increased logarithmically as the reflector depth is increased in relation to the same width. This causes uneven projected beam patterns with concentrated areas know as hot spots in a parabolic reflector system or hot spots and uneven coverage of light causing shadows in the gate of an ellipsoidal reflector system. These compressed areas also concentrate heat at the center of the projected beam that can be very detrimental to parts of the illumination system and accessories used with these systems such as, but not limited to, color gel material, gobos, plastic lens, projection slides, and film used in motion picture projectors.

SUMMARY OF THE INVENTION

Objects of the invention are to provide a reflector, or reflector lamp, having an improved optical efficiency and a projected beam pattern or gate projection area with substantially more even projection of energy in the desired beam pattern or gate without areas of compressed energy known as hot spots while also lowering the concentration of heat at the center of the projected beam. This permits a lamp design or illumination system having lower power consumption in a more compact form and a system that can be higher in power but not as harmful to lens made of plastic, or the media that it is projecting, or objects that are in the projected beam path.

These and other objects of the present invention are achieved by providing a lamp unit or a reflector system comprising a reflector and a finite light source wherein the reflector has a parabolic front section or ellipsoidal front section, and a spherical rear section. The front and rear reflector sections are joined together near the intersection of a plane passing through one of the foci of an ellipsoidal front reflector section or the focal point of a parabolic front reflector section and just behind the focal point of the spherical rear reflector section. The focal point of the front reflector section is the exact center point of the finite light source. The focal point of the rear spherical reflector section is just forward of the focal point of the front reflector section. The exact distance forward of this focal point from the forward reflector section focal point is determined by the overall size of the total reflector system and not so far forward that any of the re-reflected light would fall outside of the forward reflector section projected beam. This geometry assures that none of the light produced by the finite light source is trapped inside the spherical rear section and there are no exact reflected energy paths repeated that could create new hot spots or concentrations of heat because of the rearwardly projected light being mirrored back through the exact center of the finite light source and focal point of the front reflector section. Additionally, the spherical rear section with its' slightly forward focal point allows all of the light rays which are reflected by the spherical rear section from a finite light source positioned at the focal point of the front reflector section to be redistributed over the larger surface of the front parabolic or ellipsoidal front section and thus recovering light that would normally be wasted while also un-compressing and re-reflecting that light into the beam pattern in substantially the same geometric configuration as said parabolic or ellipsoidal front sections but distributed more evenly from center to outer edge of said projected beam producing a smoother field.

Alternately, the amount of heat produced by the reflector lamp or reflector illumination system can be reduced even more if the reflector sections are made of, or coated with, a cold mirror material that allows the heat to pass through and reflects only the visible part of the light being generated by the finite light source. Additionally, the heat radiated from the front of the finite light source can be reduced by placing a hot mirror or hot mirror coated lens in the front of the opening of the reflector lamp or reflector illumination system to reflect the heat and allow the visible light to pass through. Additionally, the quality of the projected beam of light can be enhanced by making the reflective surface of the reflector sections to have facets or fluted areas.

Still further advantages of the present invention will become apparent to those of ordinary skill in the art upon reading and understanding the following detailed description of the preferred embodiments.

DETAILED DESCRIPTION OF THE INVENTION

Reference will now be made in detail to the present preferred embodiment of the invention, examples of which are illustrated by the accompanying drawings. While the invention will be described in connection with a preferred embodiment, it will be understood that it is not intended to limit the invention to that embodiment.

Figure 1:
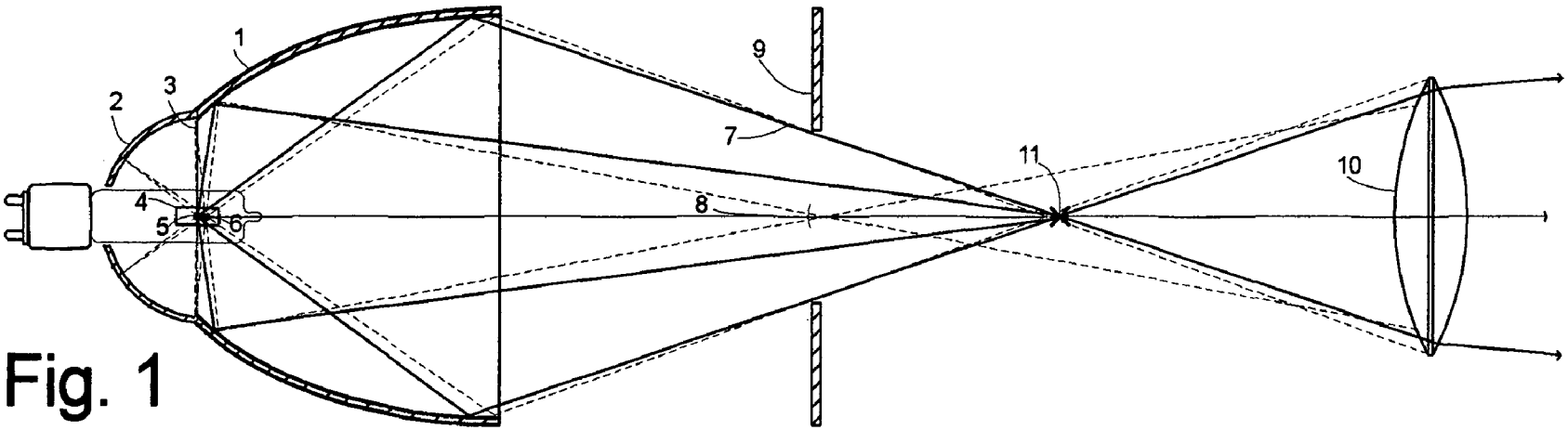
FIG. 1 is a schematic diagram of a first embodiment of an incandescent illumination system or fixture in accordance with the invention, including an incandescent lamp, a reflector with an ellipsoidal front section joined with a spherical rear section, a gate, and a collimating lens.
Figure 2A:
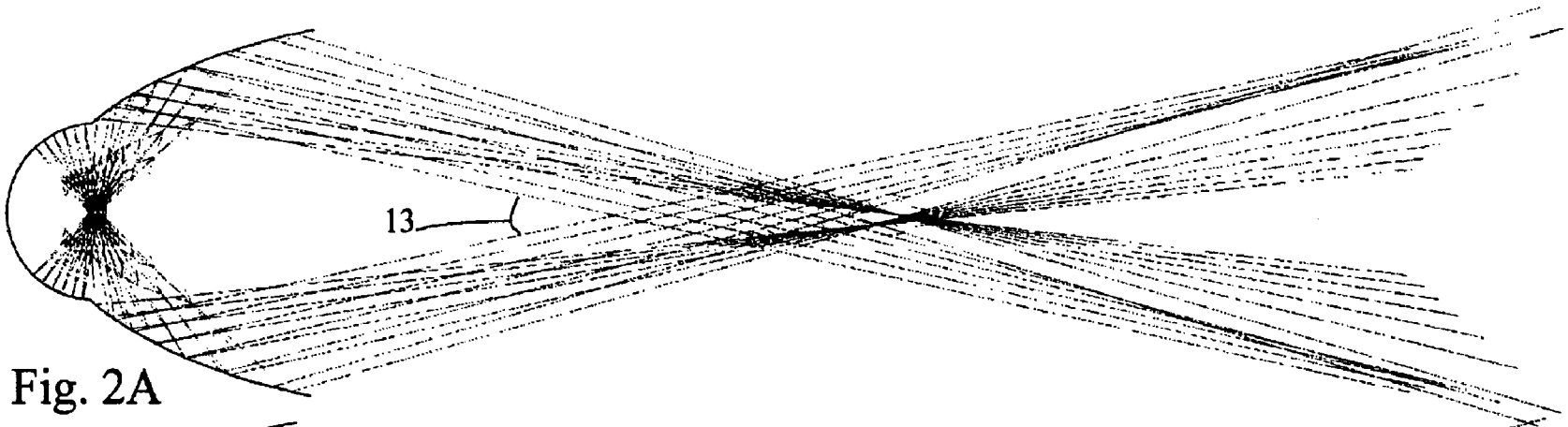
FIG. 2A is a computer generated ray tracing schematic diagram of a reflector with an ellipsoidal front section joined with a spherical rear section showing a point source generating 26 rays of energy from one of the focal points of the ellipsoidal front section.
Figure 2B:
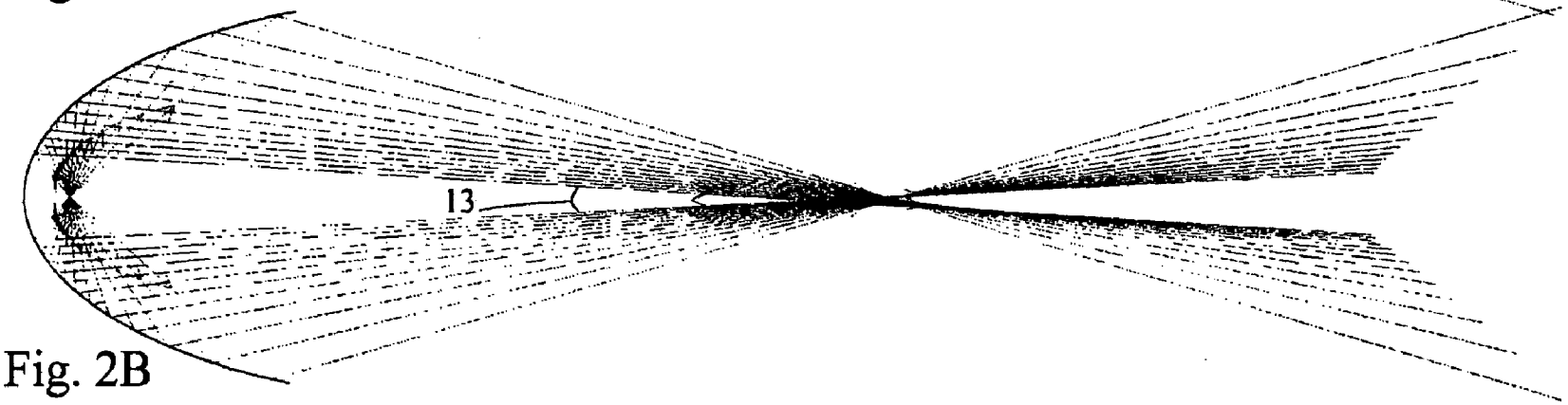
FIG. 2B is a computer generated ray tracing schematic diagram of a reflector with a standard prior art ellipsoidal contour showing a point source generating 26 rays of energy from one of the focal points of the ellipsoidal reflector.
Figure 3A:
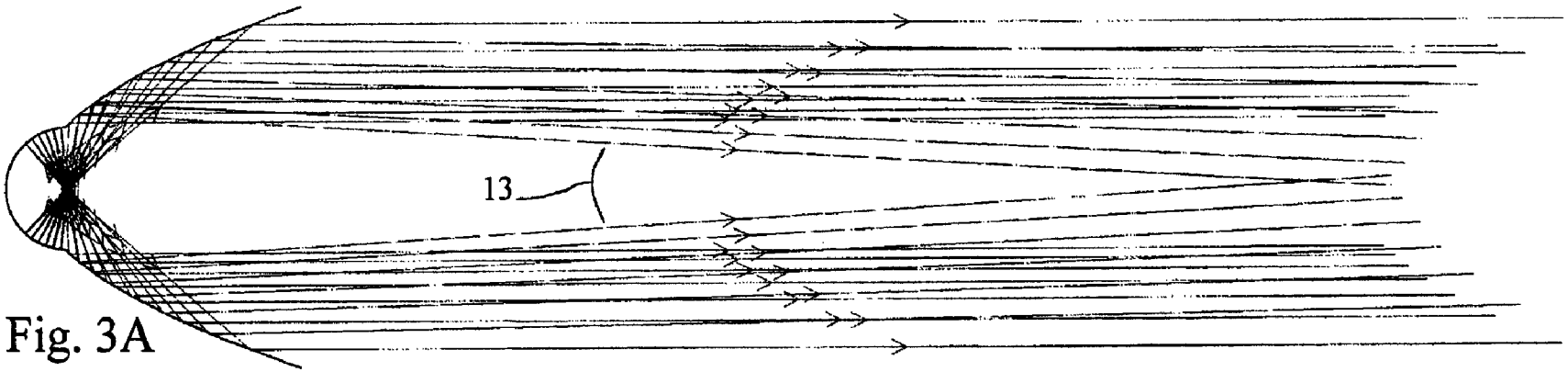
FIG. 3A is a computer generated ray tracing schematic diagram of a reflector with a parabolic front section joined with a spherical rear section showing a point source generating 26 rays of energy from the focal point of the parabolic front section.
Figure 3B:
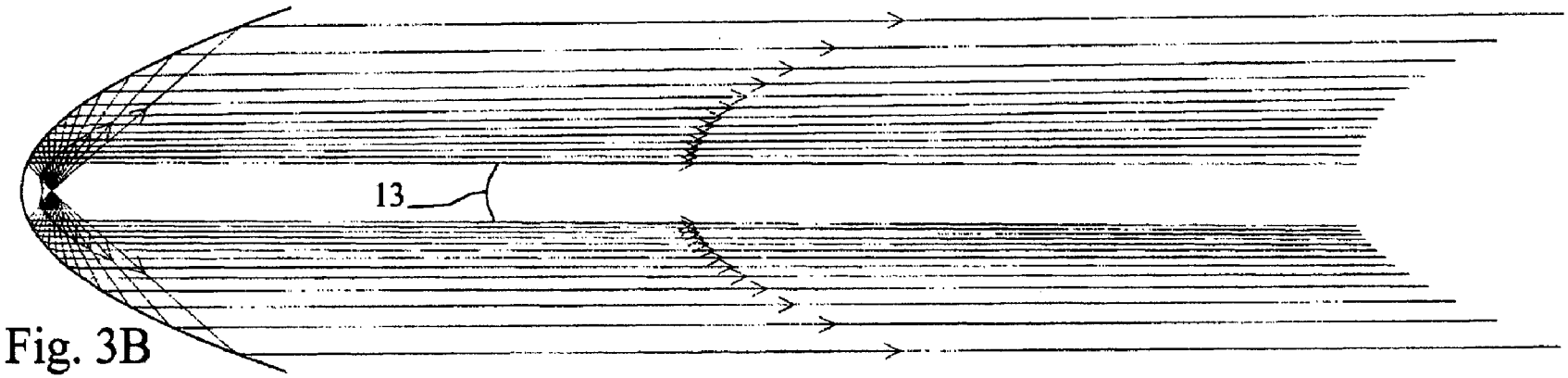
FIG. 3B is a computer generated ray tracing schematic diagram of a reflector with a standard prior art parabolic contour showing a point source generating 26 rays of energy from the focal point of the parabolic reflector.

FIG. 1 is a schematic diagram of a first embodiment of an incandescent illumination system in accordance with the invention. The reflector has an ellipsoidal front section 1 and a spherical rear section 2. The front and rear reflector sections are joined together near the intersection of a plane 3 passing through one of the foci 5 of the ellipsoidal front reflector section and just behind the focal point of the spherical rear reflector section 6. The focal point of the front reflector section is the approximate center point of the finite light source 4. The focal point of the rear spherical reflector section 6 is just forward of the focal point of the front reflector section 5. The exact distance forward of this focal point from the forward reflector section focal point is determined by the overall size of the total reflector system and not so far forward that any of the re-reflected light 8 would fall outside of the forward reflector section projected beam 7. This geometry assures that none of the light produced by the finite light source is trapped inside the spherical rear section 2 and there are no exact reflected energy paths repeated that could create new hot spots or concentrations of heat because of the rearwardly projected light being mirrored back through the exact center 5 of the finite light source 4. Additionally, the spherical rear section with its' slightly forward focal point 6 allows all of the light rays 8 which are reflected by the spherical rear section from a finite light source 4 positioned at the focal point 5 of the front reflector section 1 to be redistributed over the larger surface of the ellipsoidal front section and re-reflect that light into the beam pattern in substantially the same geometric configuration as the light rays 7 reflected by said ellipsoidal front section 1 but distributed more evenly from center to outer edge of said projected beam. This combined beam 7 and 8 then enters the gate 9 and passes the other foci 11 of the ellipsoidal front reflector section 1 and passes through the lens 10 producing a smoother and more accurate field.

Figure 4A:
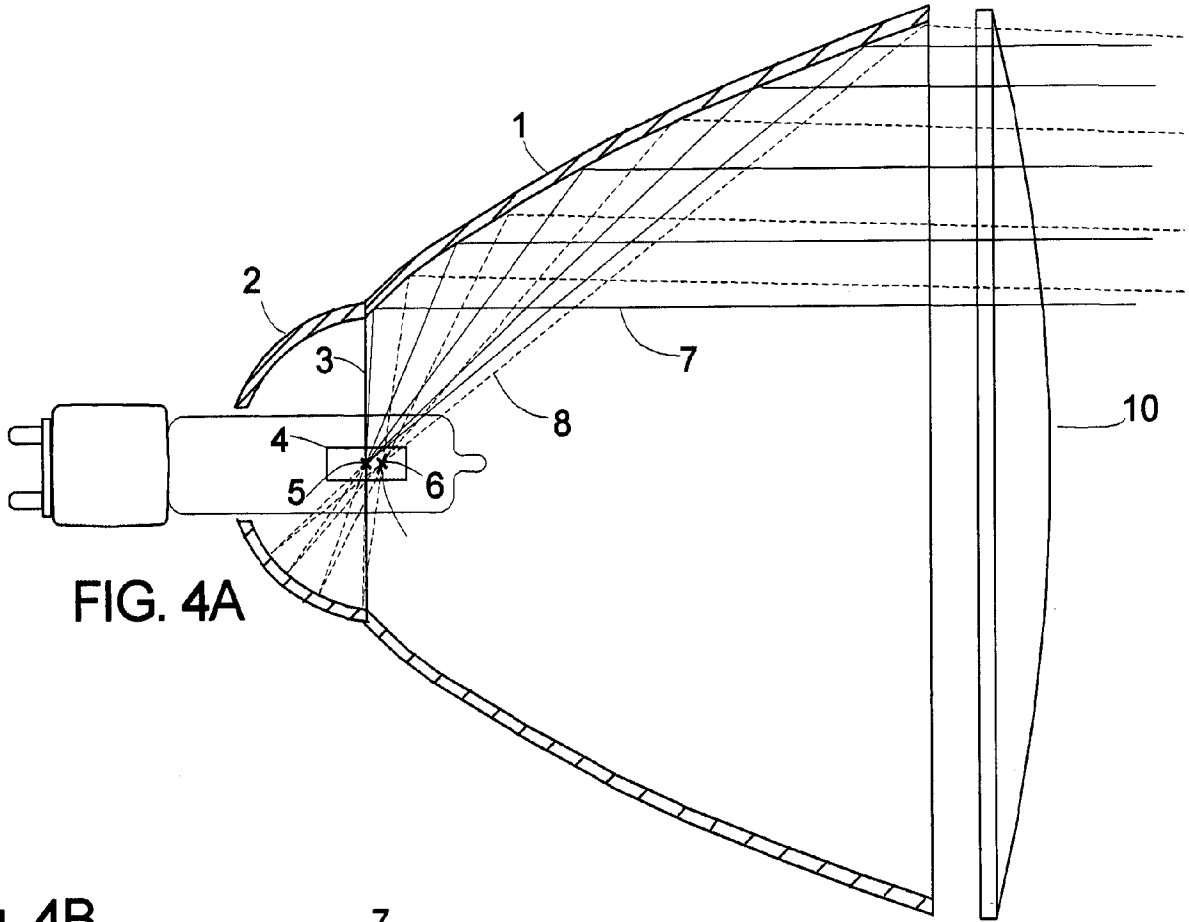
FIG. 4A is a schematic diagram of an alternative embodiment of an incandescent illumination system or fixture in accordance with the invention, this system including an incandescent lamp, a reflector with a parabolic front section joined with a spherical rear section, and an optional lens.
Figure 4B:
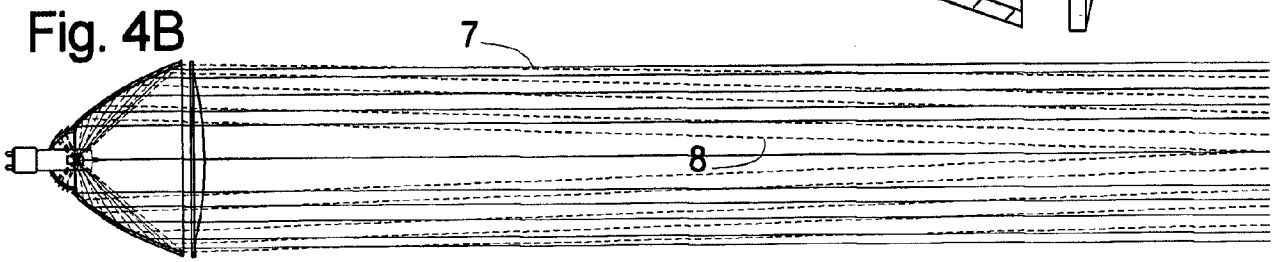
FIG. 4B is a schematic diagram showing the extended projected beam produced by the alternate embodiment of FIG. 4A.
Figure 5:
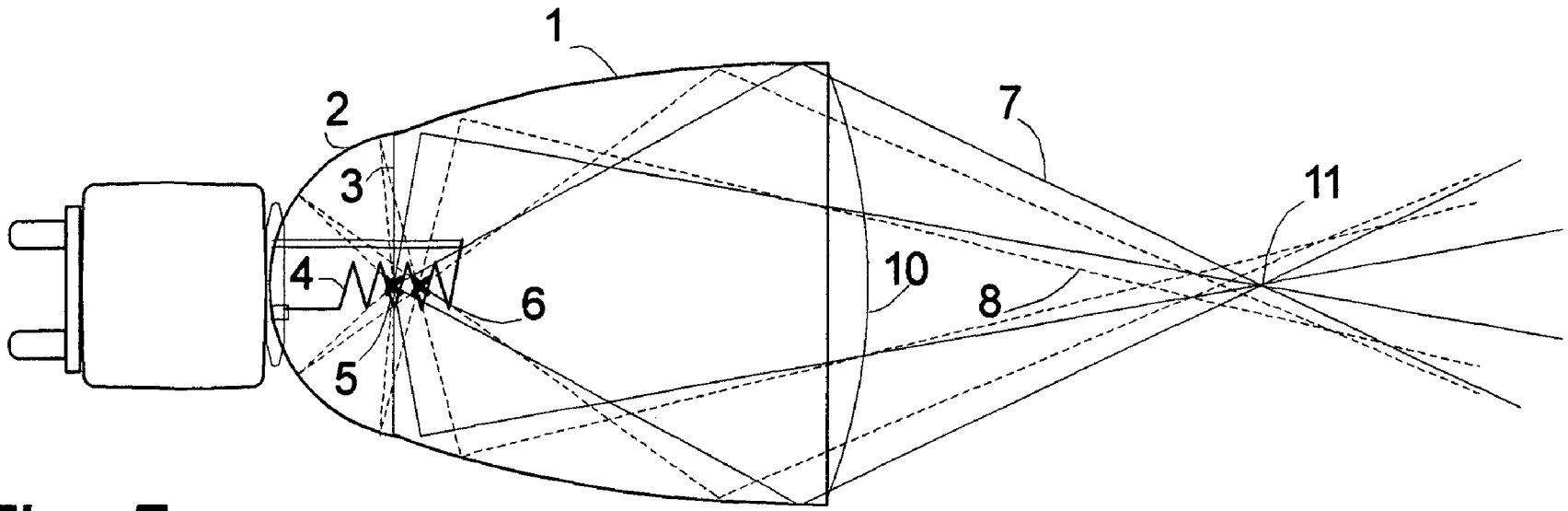
FIG. 5 is a side view of an embodiment of an incandescent lamp in accordance with the invention, this embodiment including a reflector with an ellipsoidal front section joined with a spherical rear section.
Figure 6:
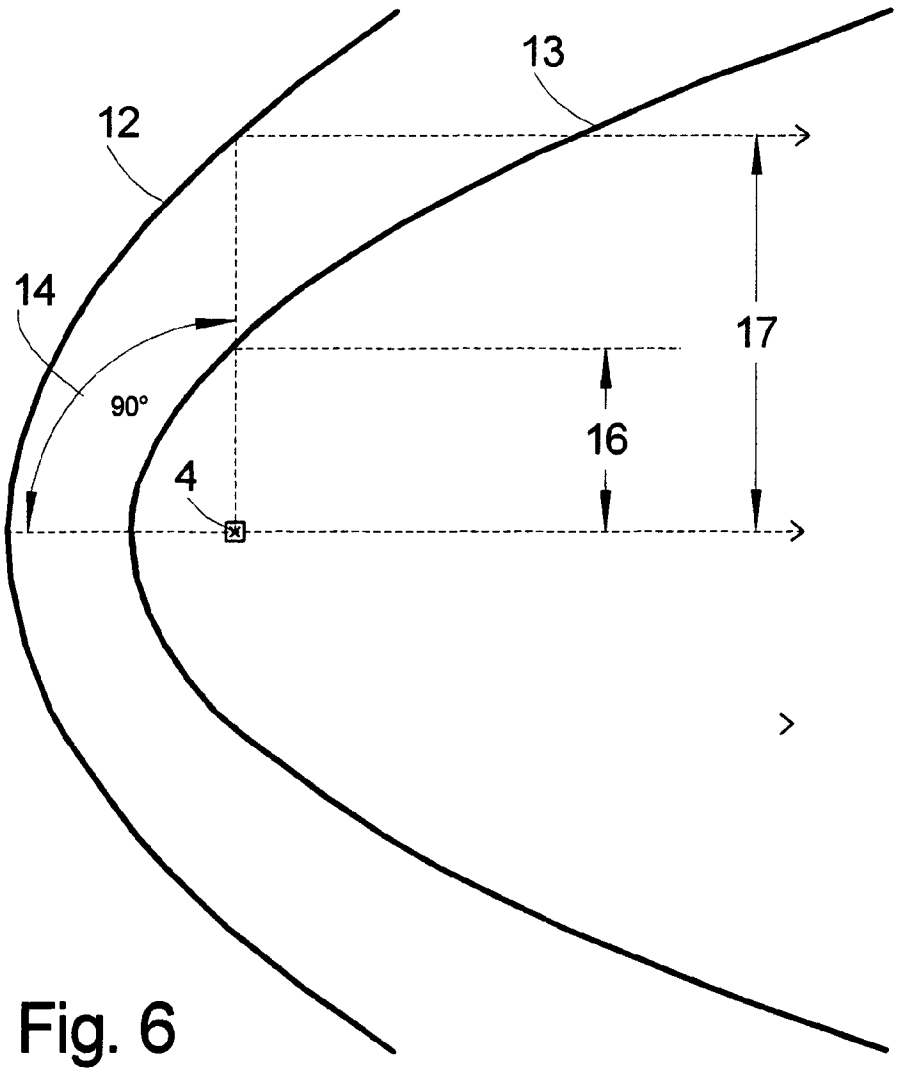
FIG. 6 is a prior art schematic diagram showing how an area of light and heat energy 17 is compressed into an area of less than half that size 16 when reflected from a deep drawn reflector 13 when the same 90 degrees of area of radiation 14 from a finite light source 4 is located at the focal point of the two reflectors that are the same diameter but have different depths.

FIG. 4 is a schematic diagram of an alternate embodiment of an incandescent illumination system in accordance with the invention. The reflector has a parabolic front section 1 and a spherical rear section 2. The front and rear reflector sections are joined together near the intersection of a plane 3 passing through the focal point 5 of the parabolic front reflector section and just behind the focal point of the spherical rear reflector section 6. The focal point of the front reflector section is the approximate center point of the finite light source 4. The focal point of the rear spherical reflector section 6 is just forward of the focal point of the front reflector section 5. The exact distance forward of this focal point from the forward reflector section focal point is determined by the overall size of the total reflector system and not so far forward that any of the re-reflected light 8 would fall outside of the forward reflector section projected beam 7. This geometry assures that none of the light produced by the finite light source is trapped inside the spherical rear section 2 and there are no exact reflected energy paths repeated that could create new hot spots or concentrations of heat because of the rearwardly projected light being mirrored back through the exact center 5 of the finite light source 4. Additionally, the spherical rear section with its' slightly forward focal point 6 allows all of the light rays 8 which are reflected by the spherical rear section from a finite light source 4 positioned at the focal point 5 of the front reflector section 1 to be redistributed over the larger surface of the parabolic front section and re-reflect that light into the beam pattern in substantially the same geometric configuration as the light rays 7 reflected by said parabolic front section 1 but distributed more evenly from center to outer edge of said projected beam producing a smoother field FIG. 5 is a schematic diagram of a first embodiment of an incandescent lamp in accordance with the invention. The envelope consist of a reflector that has a spherical rear section 2 and an ellipsoidal front section 1 with a clear lens 10 attached. The front and rear reflector sections are joined together near the intersection of a plane 3 passing through one of the foci 5 of the ellipsoidal front reflector section and just behind the focal point of the spherical rear reflector section 6. The focal point of the front reflector section is the approximate center point of the finite light source 4. The focal point of the rear spherical reflector section 6 is just forward of the focal point of the front reflector section 5. The exact distance forward of this focal point from the forward reflector section focal point is determined by the overall size of the total reflector envelope and not so far forward that any of the re-reflected light 8 would fall outside of the forward reflector section projected beam 7. This geometry assures that none of the light produced by the filament 4 is trapped inside the spherical rear section 2 and there are no exact reflected energy paths repeated that could create new hot spots or concentrations of heat because of the rearwardly projected light being mirrored back through the exact center 5 of the finite light source 4. Additionally, the spherical rear section with its' slightly forward focal point 6 allows all of the light rays 8 which are reflected by the spherical rear section 2 from a finite light source 4 positioned at the focal point 5 of the front reflector section 1 to be redistributed over the larger surface of the ellipsoidal front section and re-reflect that light into the beam pattern in substantially the same geometric configuration as the light rays 7 reflected by said ellipsoidal front section 1 but distributed more evenly from center to outer edge of said projected beam. This combined beam 7 and 8 then passes the other foci 11 of the ellipsoidal front reflector section 1 and produces a smoother and more accurate field.

Although not shown in the drawings, an alternate embodiment of a lamp in accordance with the invention is disclosed. The envelope is comprised of a reflector with a spherical rear section and a parabolic front section with clear front lens attached. The front and rear reflector sections are joined together near the intersection of a plane passing through the focal point of the parabolic front reflector section and just behind the focal point of the spherical rear reflector section. The focal point of the front reflector section is the approximate center point of the filament. The focal point of the rear spherical reflector section is just forward of the focal point of the front reflector section. The exact distance forward of this focal point from the forward reflector section focal point is determined by the overall size of the total reflector system and not so far forward that any of the re-reflected light would fall outside of the forward reflector section projected beam. This geometry assures that none of the light produced by the finite light source is trapped inside the spherical rear section and there are no exact reflected energy paths repeated that could create new hot spots or concentrations of heat because of the rearwardly projected light being mirrored back through the exact center of the finite light source. Additionally, the spherical rear section with its' slightly forward focal point allows all of the light rays which are reflected by the spherical rear section from a finite light source positioned at the focal point of the front reflector section to be redistributed over the larger surface of the parabolic front section and re-reflect that light into the beam pattern in substantially the same geometric configuration as the light rays reflected by said parabolic front section but distributed more evenly from center to outer edge of said projected beam producing a smoother field

What is claimed is:

1. An illumination system for projecting a beam of light, comprising:

a concave reflector system configured to be substantially symmetrical about a longitudinal axis wherein the reflector has a parabolic front section and a spherical rear section joined together near the intersection of a plane passing through the focal point of the parabolic front reflector section and just behind the focal point of the spherical rear reflector section:

an incandescent lamp with the approximate center of the light source placed at the focal point of the front parabolic reflector section and just behind the focal point of the rear spherical reflector section:

a lens located at an open end of the front reflector section wherein a substantial portion of the light emitted by the lamp impinges on, and is redirected by, the reflector system to project a beam of light substantially parallel with the longitudinal axis of the reflector system.

2. The illumination system of claim 1, wherein the reflector surfaces are coated with a material or made in a way that allows the infrared and heat energy of the light source to pass through but reflects the visible spectrum of the light source.

3. The illumination system of claim 1, wherein the front lens is coated with a material or made in a way that allows the infrared and heat energy of the light source to be reflected but allows the visible spectrum of the light source to pass through.

4. The illumination system of claim 1, wherein the light source is selected from the group consisting of halogen, discharge, and semiconductor light sources.

5. The illumination system of claim 1, wherein the lens is made of plastic.

6. An illumination system for projecting a beam of light, comprising:

a concave reflector system configured to be substantially symmetrical about a longitudinal axis wherein the reflector has an ellipsoidal front section and a spherical rear section joined together near the intersection of a plane passing through one of the foci of the ellipsoidal front reflector section and just behind the focal point of the spherical rear reflector section;

an incandescent lamp with the approximate center of the light source placed at one of the foci of an ellipsoidal front reflector section and just behind the focal point of the rear spherical reflector section;

a gate having an aperture aligned with the longitudinal axis of the concave reflector;

a lens aligned with the longitudinal axis of the concave reflector system and positioned on the side of the gate opposite the reflector and the incandescent lamp;

wherein a substantial portion of light emitted by the incandescent lamp is directed generally perpendicular to the longitudinal axis of the concave reflector to impinge on the reflector, which redirects the light through the gate to the lens, to project the beam of light.

7. The illumination system of claim 6, wherein the reflector surfaces are coated with a material or made in a way that allows the infrared and heat energy of the light source to pass through but reflects the visible spectrum of the light source.

8. The illumination system of claim 6, wherein the front lens is coated with a material or made in a way that allows the infrared and heat energy of the light source to be reflected but allows the visible spectrum of the light source to pass through.

9. The illumination system of claim 6, wherein the light source is selected from the group consisting of halogen, discharge, and semiconductor light sources.

10. The illumination system of claim 6, wherein the lens is made of plastic.

11. A lamp comprising:

an envelope with a concave reflector system configured to be substantially symmetrical about a longitudinal axis wherein the reflector has a parabolic front section and a spherical rear section joined together near the intersection of a plane passing through the focal point of the parabolic front reflector section and just behind the focal point of the spherical rear reflector section and joined to a lens located at an open end of the front reflector section:

an incandescent light source with the approximate center placed at the focal point of the front parabolic reflector section and just behind the focal point of the rear spherical reflector section:

wherein a substantial portion of the light emitted by the light source impinges on, and is redirected by, the reflectors to project a beam of light substantially parallel with the longitudinal axis of the reflector system.

12. The lamp of claim 11, wherein the reflector surfaces of the lamp envelope are coated with a material or made in a way that allows the infrared and heat energy of the light source to pass through but reflects the visible spectrum of the light source.

13. The lamp of claim 11, wherein the front lens of the envelope is coated with a material or made in a way that allows the infrared and heat energy of the light source to be reflected but allows the visible spectrum of the light source to pass through.

14. The lamp of claim 11, wherein the light source is selected from the group consisting of halogen, discharge, and semiconductor light sources.

15. A lamp comprising:

an envelope with a concave reflector system configured to be substantially symmetrical about a longitudinal axis wherein the reflector has an ellipsoidal front section and a spherical rear section joined together near the intersection of a plane passing through one of the foci of the ellipsoidal front reflector section and just behind the focal point of the spherical rear reflector section and joined to a lens located at an open end of the front reflector section:

an incandescent light source with the approximate center placed at the focal point of one of the foci of the ellipsoidal front reflector section and just behind the focal point of the rear spherical reflector section:

wherein a substantial portion of the light emitted by the light source impinges on, and is redirected by, the reflectors to project a beam of light.

16. The lamp of claim 15, wherein the reflector surfaces of the lamp envelope are coated with a material or made in a way that allows the infrared and heat energy of the light source to pass through but reflects the visible spectrum of the light source.

17. The lamp of claim 15, wherein the front lens of the envelope is coated with a material or made in a way that allows the infrared and heat energy of the light source to be reflected but allows the visible spectrum of the light source to pass through.

18. The lamp of claim 15, wherein the light source is selected from the group consisting of halogen, discharge, and semiconductor light sources.

* * * * *